US009149909B2

(12) United States Patent
Kanazawa et al.

(10) Patent No.: US 9,149,909 B2
(45) Date of Patent: Oct. 6, 2015

(54) STRINGER MANUFACTURING METHOD

(75) Inventors: Hiroyuki Kanazawa, Tokyo (JP); Yasuo Baba, Tokyo (JP)

(73) Assignees: MITSUBISHI HEAVY INDUSTRIES, LTD., Tokyo (JP); FLOW JAPAN CORPORATION, Tokyo (JP)

( * ) Notice: Subject to any disclaimer, the term of this patent is extended or adjusted under 35 U.S.C. 154(b) by 694 days.

(21) Appl. No.: 13/386,968

(22) PCT Filed: Oct. 13, 2010

(86) PCT No.: PCT/JP2010/067954

§ 371 (c)(1),
(2), (4) Date: Apr. 3, 2012

(87) PCT Pub. No.: WO2011/046142

PCT Pub. Date: Apr. 21, 2011

(65) Prior Publication Data

US 2012/0184185 A1 Jul. 19, 2012

(30) Foreign Application Priority Data

Oct. 14, 2009 (JP) ..... 2009-237334

(51) Int. Cl.
*B24C 1/00* (2006.01)
*B24C 3/04* (2006.01)
(Continued)

(52) U.S. Cl.
CPC . *B24C 3/04* (2013.01); *B24C 1/045* (2013.01); *B26F 3/008* (2013.01)

(58) Field of Classification Search
CPC ..... B64C 1/064; B64C 3/182; B21D 47/01; B23K 2201/28; B24C 1/045; B24C 3/04; B26F 3/008
USPC ..... 451/38; 148/196
See application file for complete search history.

(56) References Cited

U.S. PATENT DOCUMENTS 1,725,439 A * 8/1929 Burke ..... 244/129.1
2,329,270 A * 9/1943 Jones ..... 403/270
(Continued)

FOREIGN PATENT DOCUMENTS

JP 62-130200 6/1987
JP 1-103265 4/1989
(Continued)

OTHER PUBLICATIONS

International Search Report issued Jan. 18, 2011 in corresponding International Application No. PCT/JP2010/067954.
(Continued)

*Primary Examiner* — Lee D Wilson
*Assistant Examiner* — Joel Crandall
(74) *Attorney, Agent, or Firm* — Wenderoth, Lind & Ponack, L.L.P.

(57) ABSTRACT

A stringer manufacturing method for machining one end portion of an elongated member that is provided with a cap flange, a web, and a base flange and that has an inverted T-shape in a front view, an I-shape in a front view, or a T-shape in a front view into a desired shape to obtain a desired stringer. The one end portion of the elongated member is machined into a desired shape by using a vertical articulated robot (1) that has at least 6 axes and that has, at the tip of a valve unit (13), an abrasive nozzle assembly (14) that injects ultrahigh-pressure water containing abrasive and a catcher cup (15) that recovers the ultrahigh-pressure water ejected from the abrasive nozzle assembly (14).

4 Claims, 17 Drawing Sheets

(51) Int. Cl.
*B24C 1/04* (2006.01)
*B26F 3/00* (2006.01)

(56) References Cited

U.S. PATENT DOCUMENTS

| | | | | | |
|---|---|---|---|---|---|
| 3,464,684 | A | * | 9/1969 | Wilson | 266/67 |
| 3,716,959 | A | * | 2/1973 | Bernardi | 52/838 |
| 3,908,973 | A | * | 9/1975 | Martin | 266/71 |
| 4,435,902 | A | | 3/1984 | Mercer et al. | |
| 4,707,898 | A | * | 11/1987 | Creech | 148/196 |
| 4,827,679 | A | * | 5/1989 | Earle, III | 451/40 |
| 4,848,042 | A | * | 7/1989 | Smith et al. | 451/78 |
| 4,937,985 | A | * | 7/1990 | Boers et al. | 451/75 |
| 5,111,652 | A | * | 5/1992 | Andre | 451/87 |
| 5,595,040 | A | * | 1/1997 | Chen | 52/837 |
| 5,980,372 | A | * | 11/1999 | Spishak | 451/453 |
| 6,133,541 | A | * | 10/2000 | Neubauer et al. | 219/121.44 |
| 8,408,493 | B2 | * | 4/2013 | Barnard et al. | 244/119 |
| 2006/0129086 | A1 | | 6/2006 | McRury et al. | |
| 2006/0243860 | A1 | | 11/2006 | Kismarton | |
| 2007/0022707 | A1 | * | 2/2007 | Gregg et al. | 52/735.1 |
| 2012/0100343 | A1 | * | 4/2012 | Borghini-Lilli et al. | 428/156 |

FOREIGN PATENT DOCUMENTS

| | | |
|---|---|---|
| JP | 2000-766 | 1/2000 |
| JP | 2000-176840 | 6/2000 |
| JP | 2001-198830 | 7/2001 |
| JP | 2003-53851 | 2/2003 |
| JP | 2003-220428 | 8/2003 |
| JP | 2006-167461 | 6/2006 |

OTHER PUBLICATIONS

Decision to Grant a Patent issued Dec. 10, 2013 in corresponding Japanese Application No. 2009-237334.

Decision to Grant a Patent issued Dec. 10, 2013 in corresponding Japanese Application No. 2011-089289.

Decision to Grant a Patent issued Apr. 9, 2014 in corresponding Chinese Patent Application No. 201080034122.2.

Decision to Grant a Patent issued Sep. 23, 2013 in corresponding Korean Patent Application No. 2012-7002751.

Hashish, Mohamed, "Abrasive-Waterjet Machining of Composites", WJTA Jet News, Dec. 2008.

Notification issued Apr. 23, 2013 in corresponding Japanese Application No. 2009-237334 (with English Translation).

Notification issued Apr. 23, 2013 in corresponding Japanese Application No. 2011-089289 (with English Translation).

Mohamed Hashish, "Machining airframe composites with abrasive waterjet", JEC Composites Magazine, No. 47, Mar. 2009, pp. 54-58.

* cited by examiner

STRINGER MANUFACTURING METHOD

BACKGROUND OF THE INVENTION

1. Technical Field

The present invention relates to a manufacturing method for a stringer (longeron), for example, a stringer used as a reinforcing member for an aircraft main wing.

2. Description of the Related Art

For stringers used as reinforcing members for aircraft main wings, for example, there is a known stringer made of carbon fiber reinforced plastic (CFRP) disclosed in Japanese Unexamined Patent Application, Publication No. 2003-53851.

SUMMARY OF THE INVENTION

1. Technical Problem

When a stringer used as a reinforcing member for an aircraft main wing is manufactured, it may be necessary to machine the wing tip portion thereof into a shape, for example, as shown in FIG. 3 or FIG. 4, and to machine the wing root portion thereof into a shape, for example, as shown in FIG. 6 or FIG. 8. However, a stringer made of carbon fiber reinforced plastic is very hard, and, therefore, it is very difficult to machine the stringer made of carbon fiber reinforced plastic with general machining, such as drilling or milling. In conventional technologies, to machine the wing tip portion or the wing root portion, first, a drill is used to make holes at desired positions on a cutoff line on the wing tip portion or the wing root portion, and a circular saw is moved along guiding jigs that are provided for each shape, so as to connect the holes.

Thus, there are problems in that the number of processes is increased, which deteriorates the productivity, and, when the circular saw is moved, carbon fiber reinforced plastic powder scatters about, which deteriorates the working environment of workers.

There is also a problem in that the blade of the drill or the teeth of the circular saw become blunt in a relatively short time, which increases the manufacturing costs.

The present invention has been made in view of the above-described circumstances, and an object thereof is to provide a stringer manufacturing method capable of enhancing the productivity, of improving the working environment of workers, and of reducing the manufacturing costs.

2. Solutions to the Problems

The present invention employs the following solutions in order to solve the above-described problems.

According to the present invention, there is provided a stringer manufacturing method for machining one end portion of an elongated member that is provided with a cap flange, a web, and a base flange and that has an inverted T-shape in a front view, an I-shape in a front view, or a T-shape in a front view into a desired shape to obtain a desired stringer, in which the one end portion of the elongated member is machined into a desired shape by using a vertical articulated robot that has at least 6 axes and that has, at the tip of an arm, an abrasive nozzle assembly that injects ultrahigh-pressure water containing abrasive and a catcher cup that recovers the ultrahigh-pressure water ejected from the abrasive nozzle assembly.

According to the stringer manufacturing method of the present invention, one end portion of the elongated member is automatically machined into a desired shape by the vertical articulated robot that has at least 6 axes, without using tools (a drill, a circular saw, etc.) and guiding jigs, which are conventionally used.

Thus, it is possible to enhance the productivity, to improve the working environment of workers, and to reduce manufacturing costs.

According to the present invention, there is provided a stringer manufacturing method for machining one end portion of an elongated member that is provided with a cap flange, a web, and a base flange and that has an inverted T-shape in a front view, an I-shape in a front view, or a T-shape in a front view into a desired shape to obtain a desired stringer, in which the one end portion of the elongated member is machined into a desired shape by using a vertical articulated robot that has at least 6 axes and that has, at the tip of an arm, an abrasive nozzle assembly that injects ultrahigh-pressure water containing abrasive, a catcher cup that recovers the ultrahigh-pressure water injected from the abrasive nozzle assembly, and a space adjustment mechanism that adjusts the space between the abrasive nozzle assembly and the catcher cup so as to maintain the space between the catcher cup and the elongated member constant.

According to the stringer manufacturing method of the present invention, one end portion of the elongated member is automatically machined into a desired shape by the vertical articulated robot that has at least 6 axes, without using tools (a drill, a circular saw, etc.) and guiding jigs, which are conventionally used.

Thus, it is possible to enhance the productivity, to improve the working environment of workers, and to reduce manufacturing costs.

According to the stringer manufacturing method of the present invention, the distance between the catcher cup and the elongated member, more specifically, the distance between the inlet of the catcher cup and a surface of the elongated member, is kept (maintained) (substantially) constant.

Thus, it is possible to easily recover ultrahigh-pressure water containing abrasive, to produce a smooth machined surface, thus eliminating a finishing process, and to further enhance the productivity.

According to the stringer manufacturing method of the present invention, all of the ultrahigh-pressure water containing abrasive is recovered.

Thus, it is possible to maintain the moving speed (specifically, cutting speed) of the abrasive nozzle assembly and the catcher cup constant and to further enhance the productivity.

The above-described stringer manufacturing method more preferably includes the steps of: when the one end portion of the elongated member having the inverted T-shape in a front view is to be machined into a desired shape, cutting off a one-lateral-side portion of the cap flange and an upper end portion of the web that are located at the one end portion of the elongated member, after disposing the abrasive nozzle assembly and the catcher cup at one lateral side of the elongated member such that the abrasive nozzle assembly is located higher than the cap flange and the catcher cup is located lower than the cap flange, and disposing the abrasive nozzle assembly so as to be located closer to the central axis of the elongated member than the catcher cup is; cutting off an other-lateral-side portion of the cap flange and an upper end portion of the web that are located at the one end portion of the elongated member, after disposing the abrasive nozzle assembly and the catcher cup at the other lateral side of the elongated member such that the abrasive nozzle assembly is located higher than the cap flange and the catcher cup is located lower than the cap flange, and disposing the abrasive nozzle assembly so as to be located closer to the central axis of the elongated member than the catcher cup is; and cutting off a portion of the web that is located at the one end portion of the elongated member, after locating the catcher cup at one lateral side of the web, after locating the abrasive nozzle assembly at the other lateral side of the web, and disposing the abrasive nozzle assembly and the catcher cup such that the central axis thereof is parallel to an upper surface of the cap flange and a lower surface of the base flange.

According to this stringer manufacturing method, the distance between the abrasive nozzle assembly and the elongated member, more specifically, the distance between the outlet of the abrasive nozzle assembly and a surface of the elongated member, is kept (maintained) (substantially) constant.

Thus, it is possible to produce a smooth machined surface, thus eliminating a finishing process, and to further enhance the productivity.

The above-described stringer manufacturing method more preferably includes the steps of: when the one end portion of the elongated member having the I-shape in a front view is to be machined into a desired shape, cutting off a one-lateral-side portion of the base flange and a lower end portion of the web that are located at the one end portion of the elongated member, after disposing the abrasive nozzle assembly and the catcher cup at one lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup is; cutting off an other-lateral-side portion of the base flange and a lower end portion of the web that are located at the one end portion of the elongated member, after disposing the abrasive nozzle assembly and the catcher cup at the other lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup is; cutting off a portion of the web that is located at the one end portion of the elongated member, after locating the catcher cup at one lateral side of the web, after locating the abrasive nozzle assembly at the other lateral side of the web, and disposing the abrasive nozzle assembly and the catcher cup such that the central axis thereof is parallel to an upper surface of the cap flange and a lower surface of the base flange; cutting off both corner portions of the cap flange that are located at the one end portion of the elongated member, after disposing the abrasive nozzle assembly and the catcher cup at the one lateral side of the elongated member such that the abrasive nozzle assembly is located lower than the cap flange and the catcher cup is located higher than the cap flange, and disposing the abrasive nozzle assembly and the catcher cup such that the central axis thereof is parallel to a one-lateral-side surface and an other-lateral-side surface of the web; and cutting off a remaining portion of the cap flange that is located at the one end portion of the elongated member, after disposing the abrasive nozzle assembly and the catcher cup at the one lateral side of the elongated member such that the abrasive nozzle assembly is located higher than the cap flange and the catcher cup is located lower than the cap flange, and disposing the abrasive nozzle assembly and the catcher cup such that the central axis thereof is parallel to the one-lateral-side surface and the other-lateral-side surface of the web.

The above-described stringer manufacturing method more preferably includes the steps of: when the one end portion of the elongated member having the T-shape in a front view is to be machined into a desired shape, cutting off a one-lateral-side portion of the base flange and a lower end portion of the web that are located at the one end portion of the elongated member, after disposing the abrasive nozzle assembly and the catcher cup at one lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup is; cutting off an other-lateral-side portion of the base flange and a lower end portion of the web that are located at the one end portion of the elongated member, after disposing the abrasive nozzle assembly and the catcher cup at the other lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup is; cutting off a portion of the web that is located at the one end portion of the elongated member, after locating the catcher cup at one lateral side of the web, and locating the abrasive nozzle assembly at the other lateral side of the web, and disposing the abrasive nozzle assembly and the catcher cup such that the central axis thereof is parallel to an upper surface of the cap flange and a lower surface of the base flange; and cutting off a portion of the cap flange that is located at the one end portion of the elongated member, after disposing the abrasive nozzle assembly and the catcher cup at the one lateral side of the elongated member such that the abrasive nozzle assembly is located higher than the cap flange and the catcher cup is located lower than the cap flange, and disposing the abrasive nozzle assembly and the catcher cup such that the central axis thereof is parallel to a one-lateral-side surface and an other-lateral-side surface of the web.

According to one of the above-described stringer manufacturing methods, the distance between the abrasive nozzle assembly and the elongated member, more specifically, the distance between the outlet of the abrasive nozzle assembly and a surface of the elongated member, is kept (maintained) (substantially) constant.

Thus, it is possible to produce a smooth machined surface, thus eliminating a finishing process, and to further enhance the productivity.

According to one of the above-described stringer manufacturing methods, the base flange is machined prior to the cap flange, and cutting chips fall to the lower side without being accumulated on the base flange. Thus, when the cap flange is machined, the movements of the abrasive nozzle assembly and the catcher cup are not blocked by the cutting chips accumulated on the base flange.

Thus, it is possible to efficiently machine the elongated member and to further enhance the productivity.

3. Advantageous Effects of the Invention

According to the stringer manufacturing method of the present invention, an advantage is afforded in that it is possible to enhance the productivity, to improve the working environment of workers, and to reduce manufacturing costs.

DETAILED DESCRIPTION OF THE INVENTION

Stringer (longeron) manufacturing methods according to the present invention will be described below with reference to FIGS. 1 to 31.

Figure 1:
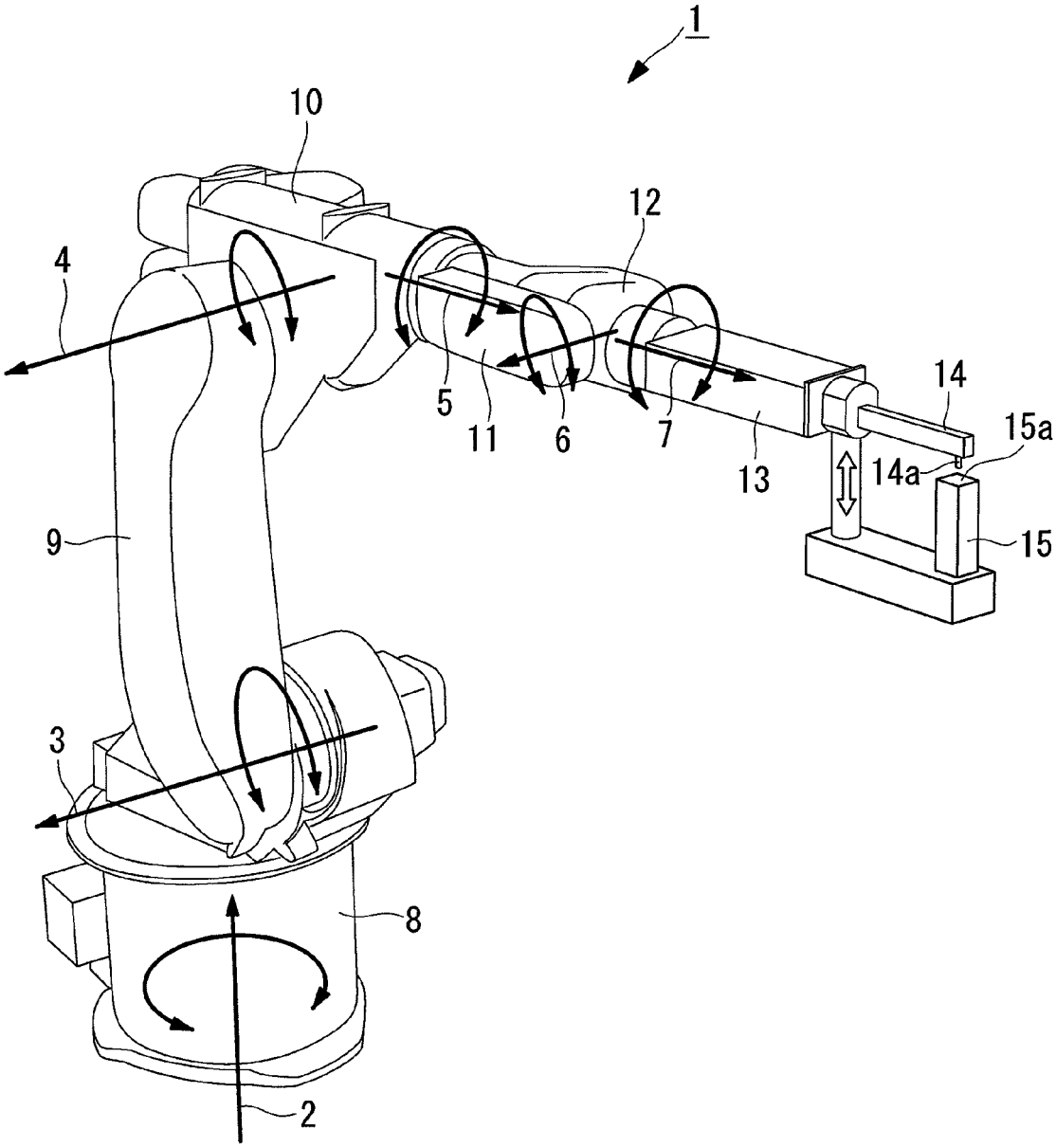
FIG. 1 is a view of the overall structure of a 6-axis robot used in stringer manufacturing methods according to the present invention.

The stringer manufacturing methods of the present invention are performed by using a 6-axis robot (vertical articulated robot) 1 shown in FIG. 1, for example. The 6-axis robot 1 is an industrial robot having a swivel base 8 and arms 9, 10, 11, and 12 that rotate about rotational axes indicated by reference numerals 2, 3, 4, 5, 6, and 7 in FIG. 1. An abrasive nozzle assembly 14 and a catcher cup 15 are attached to a tip of a valve unit 13 (the end opposite to the end of the valve unit 13 to which the arm 12 is connected).

Ultrahigh-pressure water containing abrasive (abrading agent) is ejected from an outlet 14*a* of the abrasive nozzle assembly 14 that faces an inlet 15*a* of the catcher cup 15. The ultrahigh-pressure water containing abrasive ejected from the outlet 14*a* of the abrasive nozzle assembly 14 is recovered by the catcher cup 15 via the inlet 15*a*. The height dimension (the length in the vertical direction (up and down direction in FIG. 1)) of a tip of the abrasive nozzle assembly 14 (the end thereof at the outlet 14*a* side) is set to a value from 55 mm to 24 mm depending on the size of the stringer, and the width dimension (the length in the thickness direction (a direction orthogonal to the rotational axis 7)) thereof is set to a value from 25 mm to 10 mm.

Figure 2:
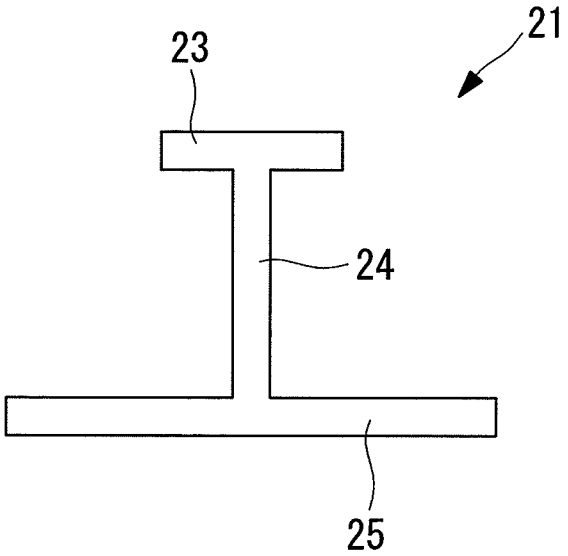
FIG. 2 is a front view of an elongated member to be machined by stringer manufacturing methods according to a first embodiment and a second embodiment of the present invention.
Figure 3:
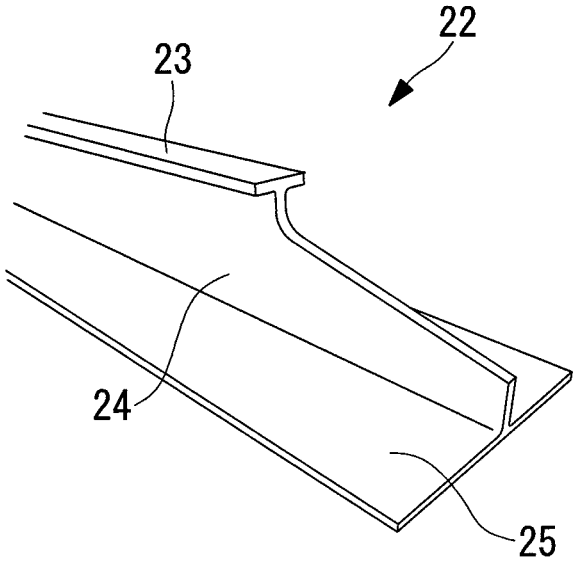
FIG. 3 is a perspective view of a stringer machined by the stringer manufacturing method according to the first embodiment of the present invention.
Figure 4:
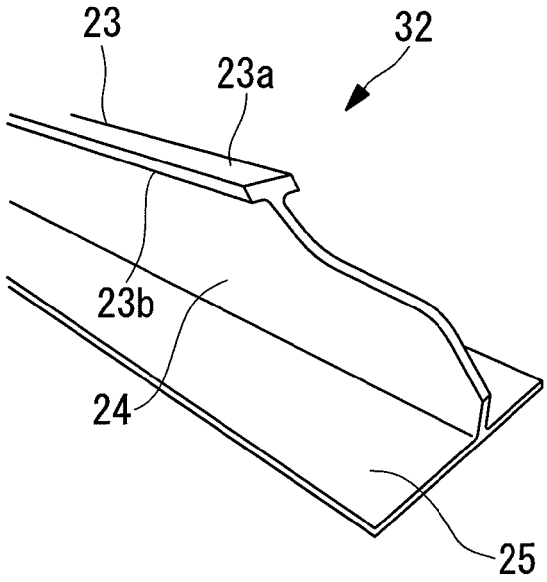
FIG. 4 is a perspective view of a stringer machined by the stringer manufacturing method according to the second embodiment of the present invention.
Figure 5:
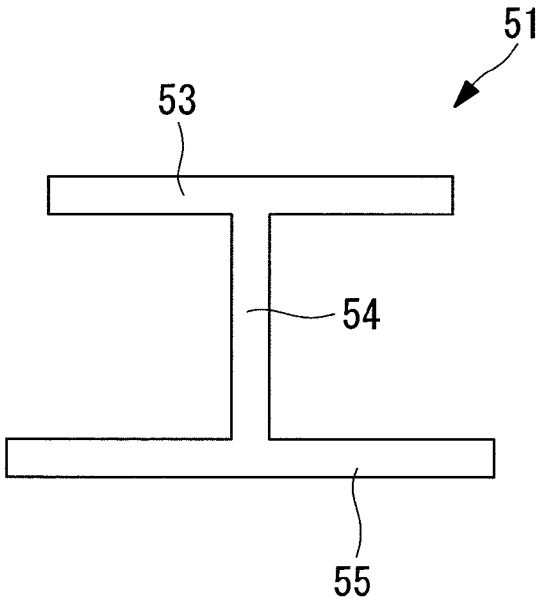
FIG. 5 is a front view of an elongated member to be machined by a stringer manufacturing method according to a third embodiment of the present invention.
Figure 6:
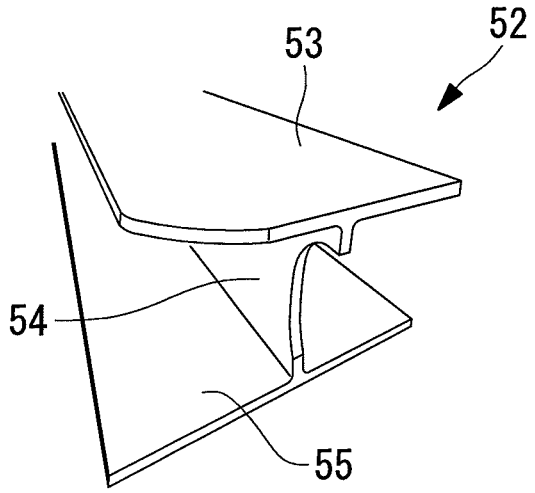
FIG. 6 is a perspective view of a stringer machined by the stringer manufacturing method according to the third embodiment of the present invention.
Figure 7:
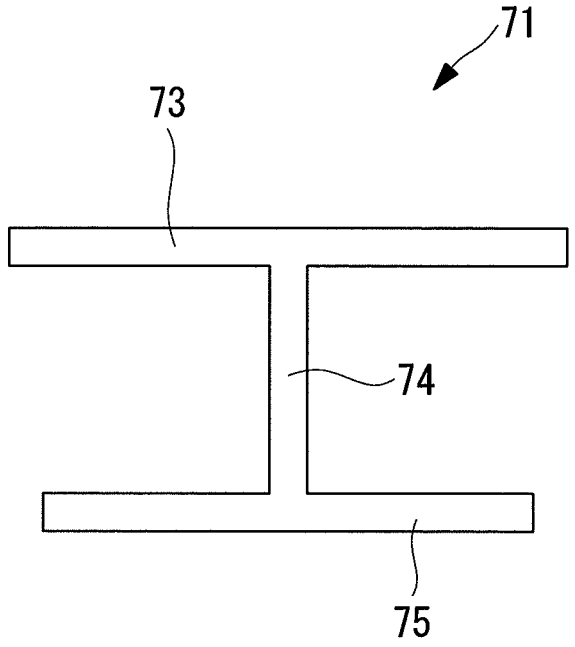
FIG. 7 is a front view of an elongated member to be machined by a stringer manufacturing method according to a fourth embodiment of the present invention.
Figure 8:
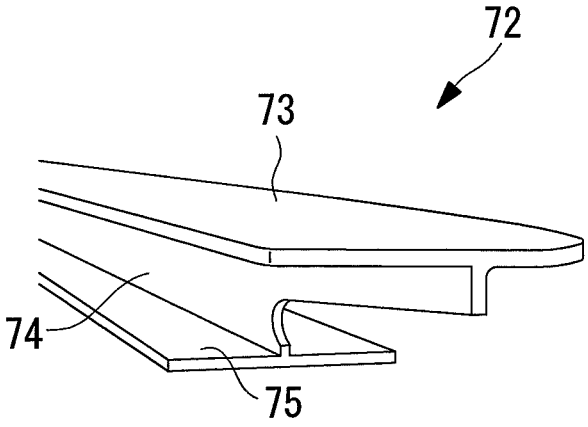
FIG. 8 is a perspective view of a stringer machined by the stringer manufacturing method according to the fourth embodiment of the present invention.

The stringer manufacturing methods of the present invention are used to machine, for example, one end portion of an elongated member (a wing tip portion if the stringer constitutes an aircraft main wing) with a cross-sectional shape shown in FIG. 2 (having a length corresponding to the length of the aircraft main wing, for example) into a shape shown in FIG. 3 or FIG. 4 by using the 6-axis robot 1; to machine, for example, one end portion of an elongated member (a wing root portion if the stringer constitutes an aircraft main wing) with a cross-sectional shape shown in FIG. 5 (having a length corresponding to the length of the aircraft main wing, for example) into a shape shown in FIG. 6 by using the 6-axis robot 1; and to machine, for example, one end portion of an elongated member (a wing root portion if the stringer constitutes an aircraft main wing) with a cross-sectional shape shown in FIG. 7 (having a length corresponding to the length of the aircraft main wing, for example) into a shape shown in FIG. 8 by using the 6-axis robot 1.

First, a description will be given of a stringer manufacturing method according to a first embodiment of the present invention, in which the 6-axis robot 1 is used to machine one end portion of an elongated member 21 shown in FIG. 2 into a shape shown in FIG. 3, thereby manufacturing a stringer 22.

The elongated member 21 is made, for example, of carbon fiber reinforced plastic (CFRP), which is formed by combining carbon fibers and plastic. As shown in FIG. 2, the elongated member 21 is provided with a cap flange 23, a web 24, and a base flange 25 wider than the cap flange 23 and is formed so as to have an inverted T-shape in cross-section (front view). The cap flange 23, the web 24, and the base flange 25 are all plate-like members and are joined to form a single unit as a whole.

Figure 9:
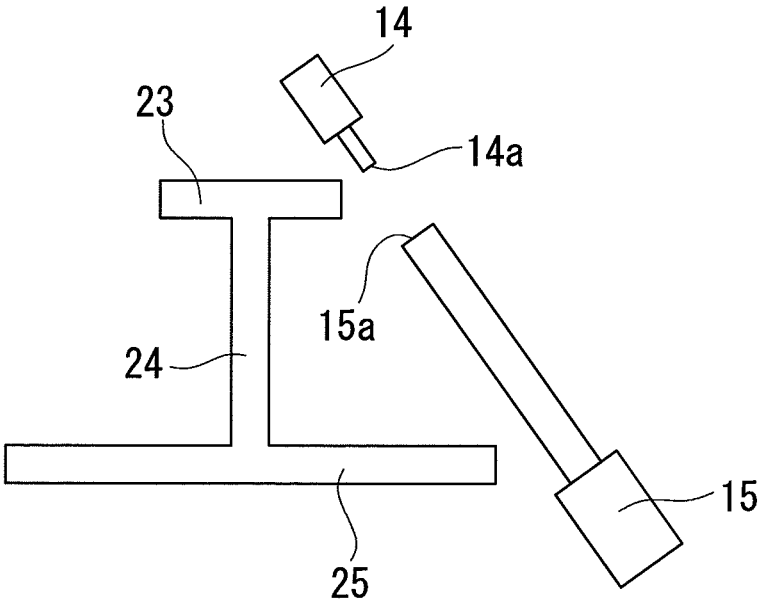
FIG. 9 is a view for explaining the stringer manufacturing methods of the present invention and is a front view as viewed from the front.
Figure 10:
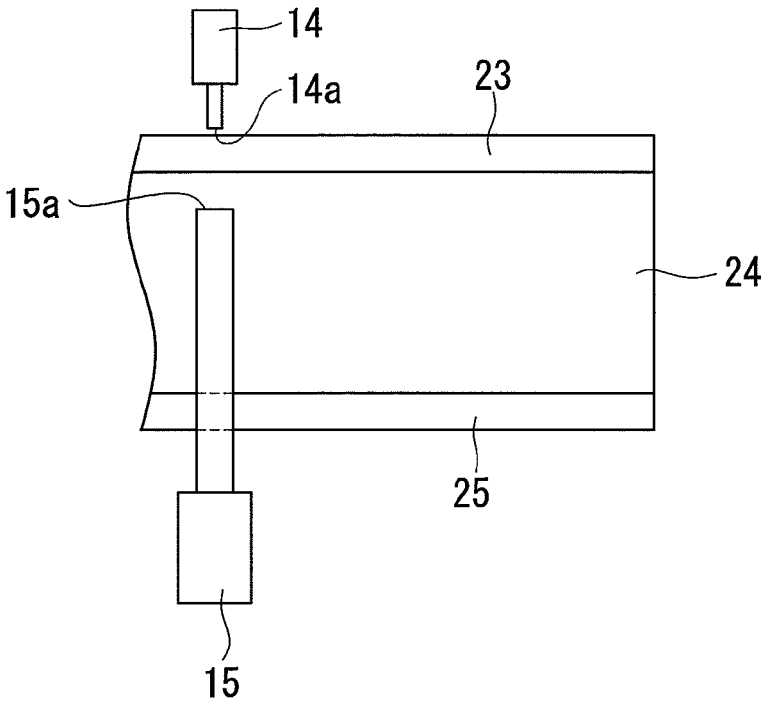
FIG. 10 is a view for explaining the stringer manufacturing method of the present invention and is a side view as viewed from a lateral side.

The elongated member 21 is secured to special jigs (not shown), and the abrasive nozzle assembly 14 and the catcher cup 15 are disposed in a state shown in FIGS. 9 and 10. Specifically, the abrasive nozzle assembly 14 and the catcher cup 15 are disposed at one lateral side of the elongated member 21 such that the abrasive nozzle assembly 14 is located higher than the cap flange 23, and the catcher cup 15 is located lower than the cap flange 23; the abrasive nozzle assembly 14 and the catcher cup 15 are disposed so as to be located in a plane orthogonal to the longitudinal axis of the elongated member 21; and the abrasive nozzle assembly 14 is disposed so as to be located closer to the inner side (closer to the web 24 or closer to the central axis of the elongated member 21) than the catcher cup 15.

Figure 11:
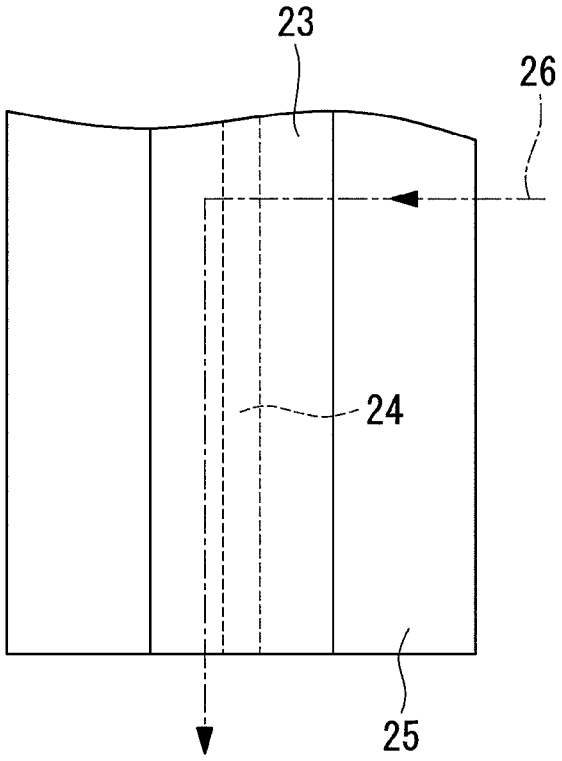
FIG. 11 is a view for explaining the stringer manufacturing methods of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIGS. 9 and 10, ultrahigh-pressure water containing abrasive is ejected from the outlet 14*a* of the abrasive nozzle assembly 14, and the abrasive nozzle assembly 14 and the catcher cup 15 are moved along a trim line (cutoff line: cutting line) 26 indicated by a one-dot chain line in FIG. 11. At this time, the abrasive nozzle assembly 14 and the catcher cup 15 are moved while maintaining the state shown in FIGS. 9 and 10. Through this stroke, a one-lateral-side portion of the cap flange 23 and an upper end portion of the web 24 that are located at one end portion of the elongated member 21 are cut off in a rectangular shape in plan view (as viewed from above).

Figure 12:
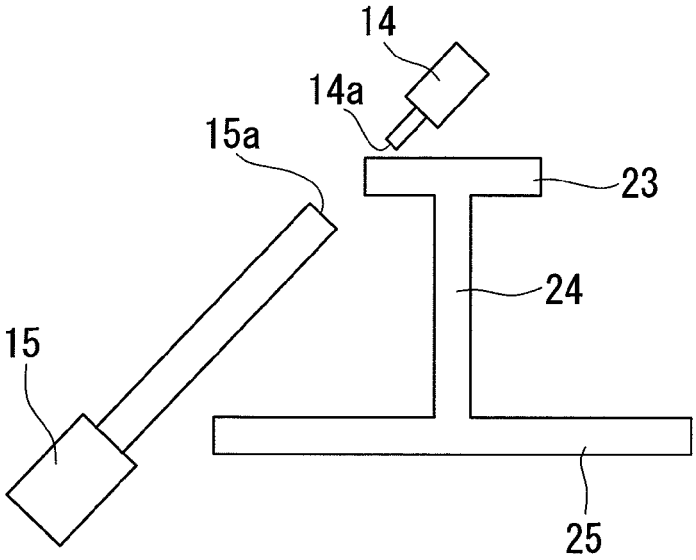
FIG. 12 is a view for explaining the stringer manufacturing methods of the present invention and is a front view as viewed from the front.

After the one-lateral-side portion of the cap flange 23 and the upper end portion of the web 24 located at one end portion of the elongated member 21 have been cut off, the injection of ultrahigh-pressure water containing abrasive is stopped, and the abrasive nozzle assembly 14 and the catcher cup 15 are then disposed in a state shown in FIGS. 10 and 12. Specifically, the abrasive nozzle assembly 14 and the catcher cup 15 are disposed at the other lateral side of the elongated member 21 such that the abrasive nozzle assembly 14 is located higher than the cap flange 23, and the catcher cup 15 is located lower than the cap flange 23; the abrasive nozzle assembly 14 and the catcher cup 15 are disposed so as to be located in a plane orthogonal to the longitudinal axis of the elongated member 21; and the abrasive nozzle assembly 14 is disposed so as to be located closer to the inner side (closer to the web 24 or closer to the central axis of the elongated member 21) than the catcher cup 15.

Figure 13:
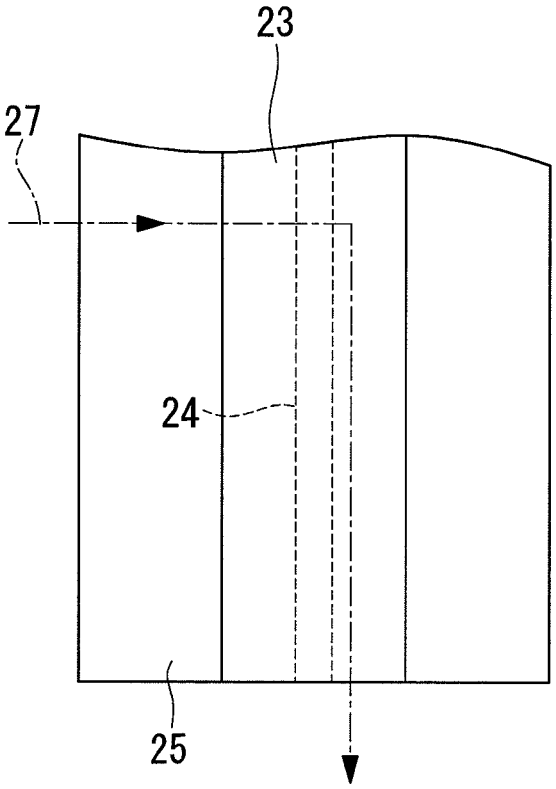
FIG. 13 is a view for explaining the stringer manufacturing methods of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIGS. 10 and 12, ultrahigh-pressure water containing abrasive is ejected again from the outlet 14*a* of the abrasive nozzle assembly 14, and the abrasive nozzle assembly 14 and the catcher cup 15 are moved along a trim line 27 indicated by a one-dot chain line in FIG. 13. At this time, the abrasive nozzle assembly 14 and the catcher cup 15 are moved while maintaining the state shown in FIGS. 10 and 12. Through this stroke, an other-lateral-side portion of the cap flange 23 and an upper end portion of the web 24 that are located at one end portion of the elongated member 21 are cut off in a rectangular shape in plan view (as viewed from above).

Figure 14:
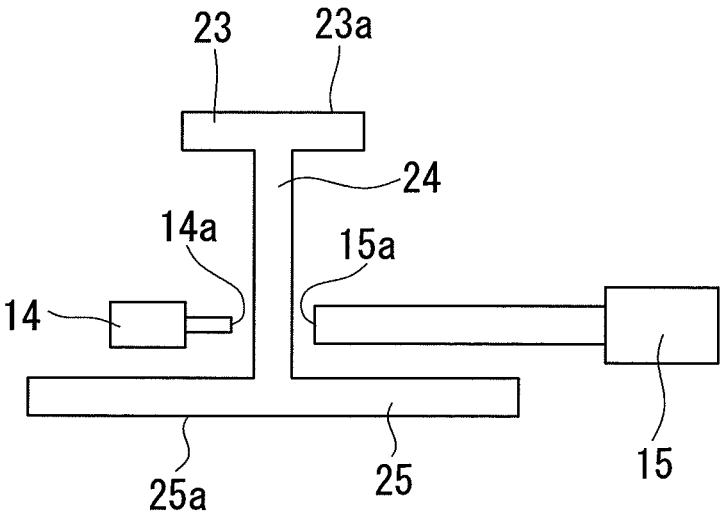
FIG. 14 is a view for explaining the stringer manufacturing methods of the present invention and is a front view as viewed from the front.

After the other-lateral-side portion of the cap flange 23 and the upper end portion of the web 24 located at one end portion of the elongated member 21 have been cut off, the injection of ultrahigh-pressure water containing abrasive is stopped, and the abrasive nozzle assembly 14 and the catcher cup 15 are then disposed in a state shown in FIG. 14. Specifically, the abrasive nozzle assembly 14 and the catcher cup 15 are disposed such that the catcher cup 15 is located at one lateral side of the web 24, and the abrasive nozzle assembly 14 is located at the other lateral side of the web 24, the abrasive nozzle assembly 14 and the catcher cup 15 are located in a plane orthogonal to the longitudinal axis of the elongated member 21, and the central axis of the abrasive nozzle assembly 14 and the catcher cup 15 is parallel to an upper surface 23*a* of the cap flange 23 and a lower surface 25*a* of the base flange 25.

Figure 15:
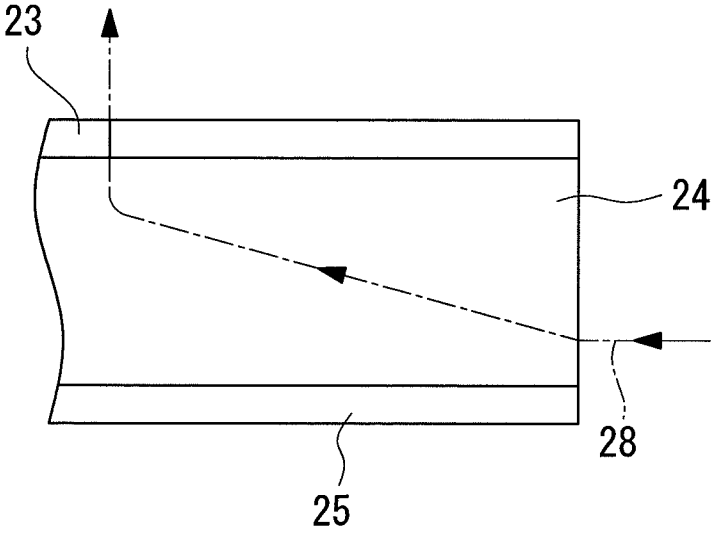
FIG. 15 is a view for explaining the stringer manufacturing method of the present invention and is a side view as viewed from a lateral side.

After the abrasive nozzle assembly 14 and the catcher cup 15 are disposed at the predetermined positions, specifically, after the abrasive nozzle assembly 14 and the catcher cup 15 are disposed in the state shown in FIG. 14, ultrahigh-pressure water containing abrasive is ejected again from the outlet 14*a* of the abrasive nozzle assembly 14, and the abrasive nozzle assembly 14 and the catcher cup 15 are moved along a trim line 28 indicated by a one-dot chain line in FIG. 15. At this time, the abrasive nozzle assembly 14 and the catcher cup 15 are moved while maintaining the state shown in FIG. 14. Through this stroke, a portion of the web 24 located at one end portion of the elongated member 21 is cut off in a nearly-trapezoidal shape in side view (as viewed from a lateral side).

The thus-formed stringer 22 (see FIG. 3) is used (utilized) as a stringer that constitutes an aircraft main wing, for example.

According to the stringer manufacturing method of this embodiment, machining of one end portion of the elongated member 21 into a desired shape is automatically performed by the 6-axis robot 1, without using tools (a drill, a circular saw, etc.) and guiding jigs, which are conventionally used.

Thus, it is possible to enhance the productivity, to improve the working environment of workers, and to reduce manufacturing costs.

According to the stringer manufacturing method of this embodiment, the distance between the abrasive nozzle assembly 14 and the elongated member 21, more specifically, the distance between the outlet 14*a* of the abrasive nozzle assembly 14 and a surface of the elongated member 21, is kept (maintained) (substantially) constant.

Thus, it is possible to produce a smooth machined surface, thus eliminating a finishing process, and to further enhance the productivity.

Next, a description will be given of a stringer manufacturing method according to a second embodiment of the present invention, in which the 6-axis robot 1 is used to machine one end portion of the elongated member 21 shown in FIG. 2 into a shape shown in FIG. 4, thereby manufacturing a stringer 32.

Figure 16:
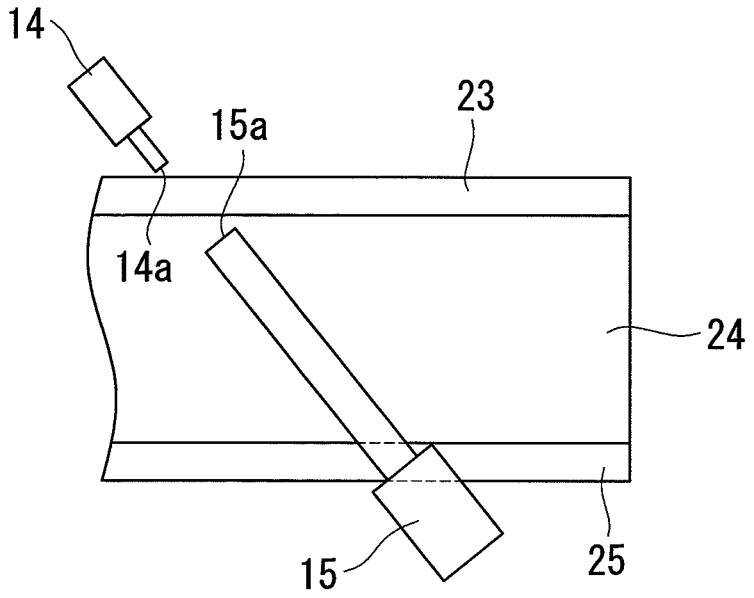
FIG. 16 is a view for explaining the stringer manufacturing method of the present invention and is a side view as viewed from a lateral side.

As in the above-described embodiment, the elongated member 21 is secured to special jigs (not shown), and the abrasive nozzle assembly 14 and the catcher cup 15 are disposed in a state shown in FIGS. 9 and 16. Specifically, the abrasive nozzle assembly 14 and the catcher cup 15 are disposed at one lateral side of the elongated member 21 such that the abrasive nozzle assembly 14 is located higher than the cap flange 23 and the catcher cup 15 is located lower than the cap flange 23; the abrasive nozzle assembly 14 is disposed so as to be located closer to the other end of the elongated member 21 than the catcher cup 15 is; and the abrasive nozzle assembly 14 is disposed so as to be located closer to the inner side (closer to the web 24 or closer to the central axis of the elongated member 21) than the catcher cup 15.

After the abrasive nozzle assembly 14 and the catcher cup 15 are disposed at the predetermined positions, specifically, after the abrasive nozzle assembly 14 and the catcher cup 15 are disposed in the state shown in FIGS. 9 and 16, ultrahigh-pressure water containing abrasive is ejected from the outlet 14*a* of the abrasive nozzle assembly 14, and the abrasive nozzle assembly 14 and the catcher cup 15 are moved along the trim line 26 indicated by the one-dot chain line in FIG. 11. At this time, the abrasive nozzle assembly 14 and the catcher cup 15 are moved while maintaining the state shown in FIGS. 9 and 16. Through this stroke, a one-lateral-side portion of the cap flange 23 and an upper end portion of the web 24 that are located at one end portion of the elongated member 21 are cut off in a rectangular shape in plan view (as viewed from above).

Since the abrasive nozzle assembly 14 is disposed closer to the other end of the elongated member 21 than the catcher cup 15 is, the cut end of the cap flange 23 is made slanted, as shown in FIG. 4; specifically, the end of the upper surface 23*a* of the cap flange 23 is located closer to the other end of the elongated member 21 than the end of a lower surface 23*b* thereof.

After the one-lateral-side portion of the cap flange 23 and the upper end portion of the web 24 located at one end portion of the elongated member 21 have been cut off, the injection of ultrahigh-pressure water containing abrasive is stopped, and the abrasive nozzle assembly 14 and the catcher cup 15 are then disposed in a state shown in FIGS. 12 and 16. Specifically, the abrasive nozzle assembly 14 and the catcher cup 15 are disposed at the other lateral side of the elongated member 21 such that the abrasive nozzle assembly 14 is located higher than the cap flange 23 and the catcher cup 15 is located lower than the cap flange 23; the abrasive nozzle assembly 14 is disposed so as to be located closer to the other end of the elongated member 21 than the catcher cup 15 is; and the abrasive nozzle assembly 14 is disposed so as to be located closer to the inner side (closer to the web 24 or closer to the central axis of the elongated member 21) than the catcher cup 15.

After the abrasive nozzle assembly 14 and the catcher cup 15 are disposed at the predetermined positions, specifically, after the abrasive nozzle assembly 14 and the catcher cup 15 are disposed in the state shown in FIGS. 12 and 16, ultrahigh-pressure water containing abrasive is ejected again from the outlet 14*a* of the abrasive nozzle assembly 14, the abrasive nozzle assembly 14 and the catcher cup 15 are moved along the trim line 27 indicated by the one-dot chain line in FIG. 13. At this time, the abrasive nozzle assembly 14 and the catcher cup 15 are moved while maintaining the state shown in FIGS. 12 and 16. Through this stroke, an other-lateral-side portion of the cap flange 23 and an upper end portion of the web 24 that are located at one end portion of the elongated member 21 are cut off in a rectangular shape in plan view (as viewed from above).

After the other-lateral-side portion of the cap flange 23 and the upper end portion of the web 24 located at one end portion of the elongated member 21 have been cut off, the injection of ultrahigh-pressure water containing abrasive is stopped, and the abrasive nozzle assembly 14 and the catcher cup 15 are then disposed in the state shown in FIG. 14. Specifically, the abrasive nozzle assembly 14 and the catcher cup 15 are disposed such that the catcher cup 15 is located at one lateral side of the web 24, the abrasive nozzle assembly 14 is located at the other lateral side of the web 24, the abrasive nozzle assembly 14 and the catcher cup 15 are located in a plane orthogonal to the longitudinal axis of the elongated member 21, and the central axis of the abrasive nozzle assembly 14 and the catcher cup 15 is parallel to the upper surface 23*a* of the cap flange 23 and the lower surface 25*a* of the base flange 25.

Figure 17:
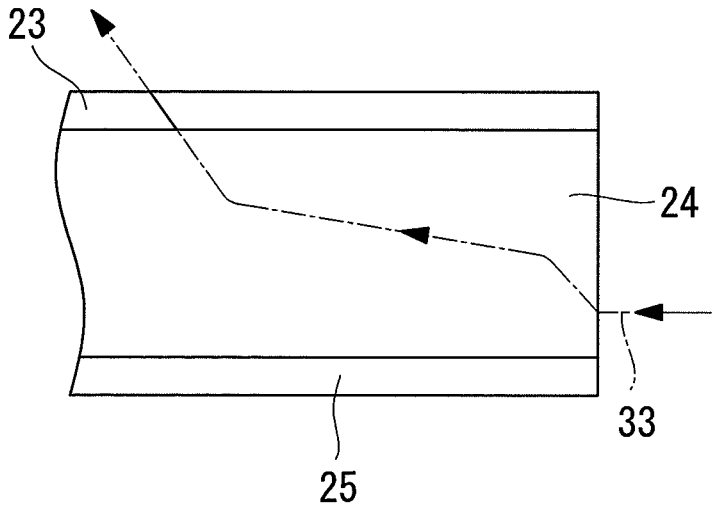
FIG. 17 is a view for explaining the stringer manufacturing method of the present invention and is a side view as viewed from a lateral side.

After the abrasive nozzle assembly 14 and the catcher cup 15 are disposed at the predetermined positions, specifically, after the abrasive nozzle assembly 14 and the catcher cup 15 are disposed in the state shown in FIG. 14, ultrahigh-pressure water containing abrasive is ejected again from the outlet 14*a* of the abrasive nozzle assembly 14, and the abrasive nozzle assembly 14 and the catcher cup 15 are moved along a trim line 33 indicated by a one-dot chain line in FIG. 17. At this time, the abrasive nozzle assembly 14 and the catcher cup 15 are moved while maintaining the state shown in FIG. 14. Through this stroke, a portion of the web 24 located at one end portion of the elongated member 21 is cut off in a wave-like shape in side view (as viewed from a lateral side).

The thus-formed stringer 32 (see FIG. 4) is used (utilized) as a stringer that constitutes an aircraft main wing, for example.

Since the functional effects of this embodiment are the same as those of the above-described first embodiment, a description thereof will be omitted.

Next, a description will be given of a stringer manufacturing method according to a third embodiment of the present invention, in which the 6-axis robot 1 is used to machine one end portion of an elongated member 51 shown in FIG. 5 into a shape shown in FIG. 6, thereby manufacturing a stringer 52.

The elongated member 51 is made, for example, of carbon fiber reinforced plastic (CFRP), which is formed by combining carbon fibers and plastic. As shown in FIG. 5, the elongated member 51 is provided with a cap flange 53, a web 54, and a base flange 55 slightly wider than the cap flange 53 and is formed so as to have an I-shape (or an H-shape) in cross-section (front view). The cap flange 53, the web 54, and the base flange 55 are all plate-like members and are joined to form a single unit as a whole.

Figure 18:
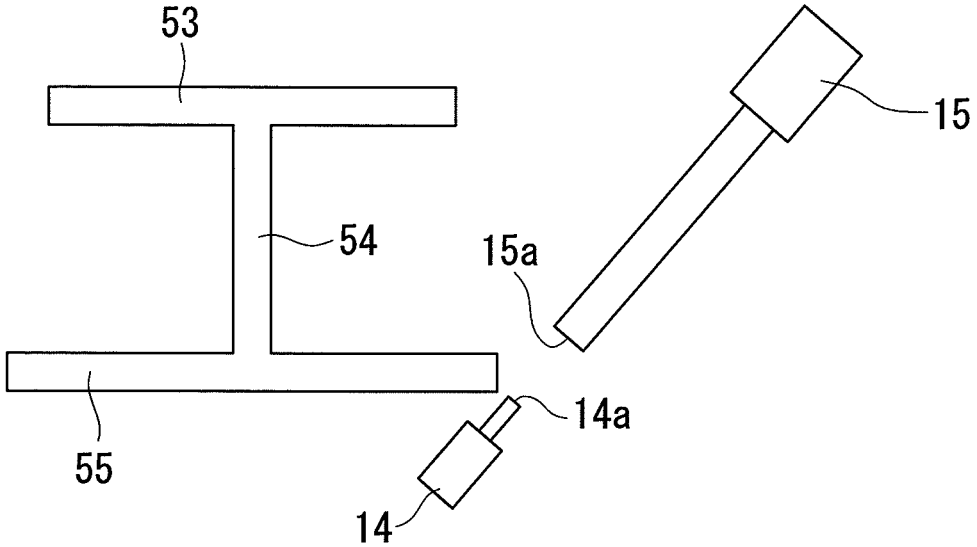
FIG. 18 is a view for explaining the stringer manufacturing methods of the present invention and is a front view as viewed from the front.

As in the above-described embodiments, the elongated member 51 is secured to special jigs (not shown), and the abrasive nozzle assembly 14 and the catcher cup 15 are disposed in a state shown in FIG. 18. Specifically, the abrasive nozzle assembly 14 and the catcher cup 15 are disposed at one lateral side of the elongated member 51 such that the abrasive nozzle assembly 14 is located lower than the base flange 55 and the catcher cup 15 is located higher than the base flange 55; the abrasive nozzle assembly 14 and the catcher cup 15 are disposed so as to be located in a plane orthogonal to the longitudinal axis of the elongated member 51; and the abrasive nozzle assembly 14 is disposed so as to be located closer to the inner side (closer to the web 54 or closer to the central axis of the elongated member 51) than the catcher cup 15.

Figure 19:
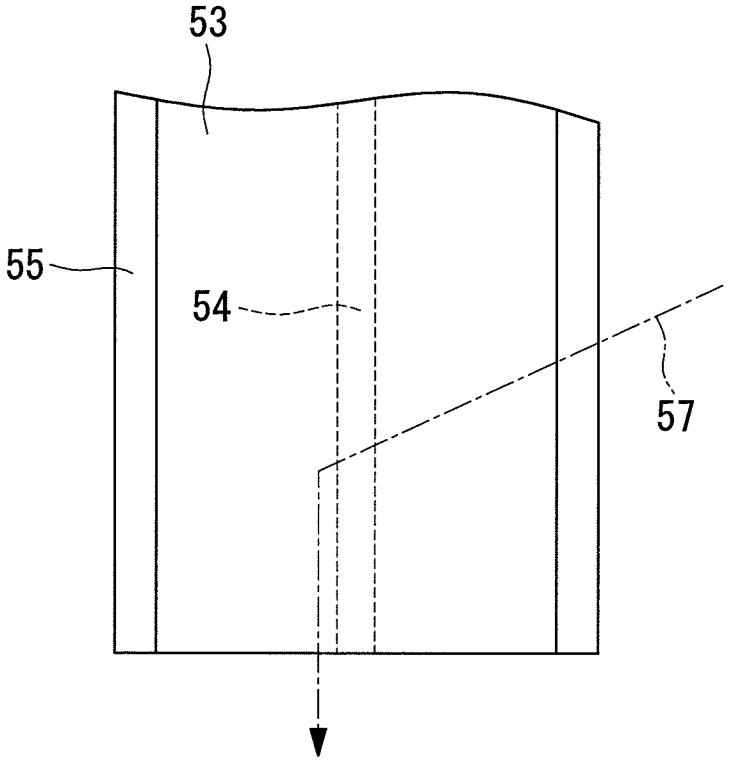
FIG. 19 is a view for explaining the stringer manufacturing method of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIG. 18, ultrahigh-pressure water containing abrasive is ejected again from the outlet 14*a* of the abrasive nozzle assembly 14, and the abrasive nozzle assembly 14 and the catcher cup 15 are moved along a trim line 57 indicated by a one-dot chain line in FIG. 19. At this time, the abrasive nozzle assembly 14 and the catcher cup 15 are moved while maintaining the state shown in FIG. 18. Through this stroke, a one-lateral-side portion of the base flange 55 and a lower end portion of the web 54 that are located at one end portion of the elongated member 51 are cut off in a trapezoidal shape in plan view (as viewed from above).

Figure 20:
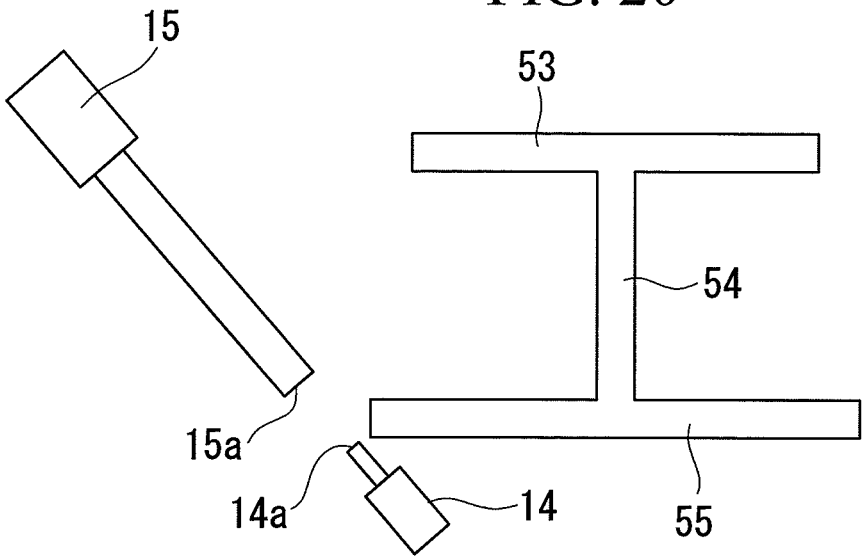
FIG. 20 is a view for explaining the stringer manufacturing methods of the present invention and is a front view as viewed from the front.

After the one-lateral-side portion of the base flange 55 and the lower end portion of the web 54 located at one end portion of the elongated member 51 have been cut off, the injection of ultrahigh-pressure water containing abrasive is stopped, and the abrasive nozzle assembly 14 and the catcher cup 15 are then disposed in a state shown in FIG. 20. Specifically, the abrasive nozzle assembly 14 and the catcher cup 15 are disposed at the other lateral side of the elongated member 51 such that the abrasive nozzle assembly 14 is located lower than the base flange 55 and the catcher cup 15 is located higher than the base flange 55; the abrasive nozzle assembly 14 and the catcher cup 15 are disposed so as to be located in a plane orthogonal to the longitudinal axis of the elongated member 51; and the abrasive nozzle assembly 14 is disposed so as to be located closer to the inner side (closer to the web 54 or closer to the central axis of the elongated member 51) than the catcher cup 15.

Figure 21:
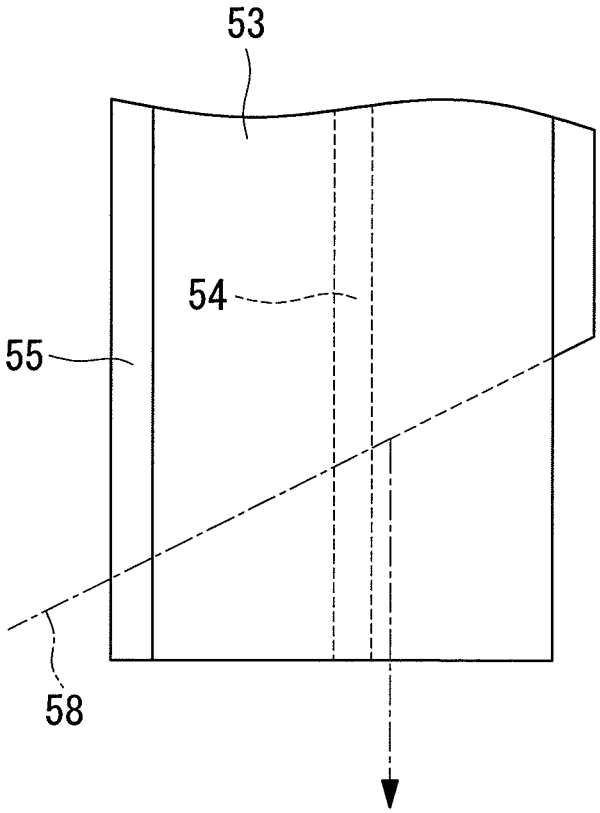
FIG. 21 is a view for explaining the stringer manufacturing method of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIG. 20, ultrahigh-pressure water containing abrasive is ejected again from the outlet 14*a* of the abrasive nozzle assembly 14, and the abrasive nozzle assembly 14 and the catcher cup 15 are moved along a trim line 58 indicated by a one-dot chain line in FIG. 21. At this time, the abrasive nozzle assembly 14 and the catcher cup 15 are moved while maintaining the state shown in FIG. 20. Through this stroke, an other-lateral-side portion of the base flange 55 and a lower end portion of the web 54 that are located at one end portion of the elongated member 51 are cut off in a trapezoidal shape in plan view (as viewed from above).

Figure 22:
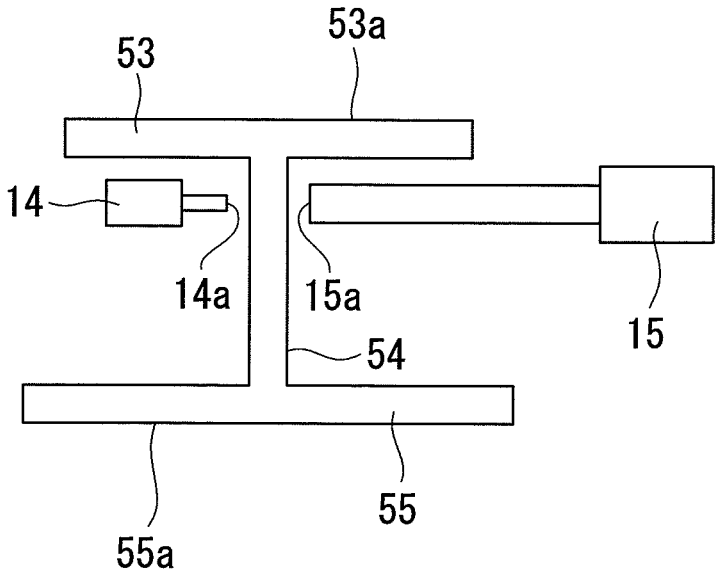
FIG. 22 is a view for explaining the stringer manufacturing methods of the present invention and is a front view as viewed from the front.

After the portion of the base flange 55 located at one end portion of the elongated member 51 has been cut off, the abrasive nozzle assembly 14 and the catcher cup 15 are then disposed in a state shown in FIG. 22. Specifically, the abrasive nozzle assembly 14 and the catcher cup 15 are disposed such that the catcher cup 15 is located at one lateral side of the web 24 and the abrasive nozzle assembly 14 is located at the other lateral side of the web 24; the abrasive nozzle assembly 14 and the catcher cup 15 are disposed so as to be located in a plane orthogonal to the longitudinal axis of the elongated member 51; and the abrasive nozzle assembly 14 and the catcher cup 15 are disposed such that the central axis thereof is parallel to an upper surface 53*a* of the cap flange 53 and a lower surface 55*a* of the base flange 55.

Figure 23:
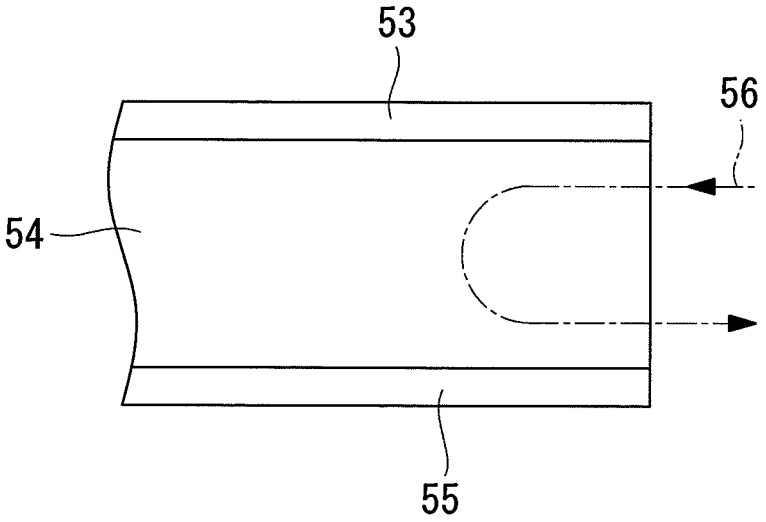
FIG. 23 is a view for explaining the stringer manufacturing method of the present invention and is a side view as viewed from a lateral side.

After the abrasive nozzle assembly 14 and the catcher cup 15 are disposed at the predetermined positions, specifically, after the abrasive nozzle assembly 14 and the catcher cup 15 are disposed in the state shown in FIG. 22, ultrahigh-pressure water containing abrasive is ejected from the outlet 14*a* of the abrasive nozzle assembly 14, and the abrasive nozzle assembly 14 and the catcher cup 15 are moved along a trim line 56 indicated by a one-dot chain line in FIG. 23. At this time, the abrasive nozzle assembly 14 and the catcher cup 15 are moved while maintaining the state shown in FIG. 22. Through this stroke, a portion of the web 54 located at one end portion of the elongated member 51 is cut off in a U-shape in side view (as viewed from a lateral side).

Figure 24:
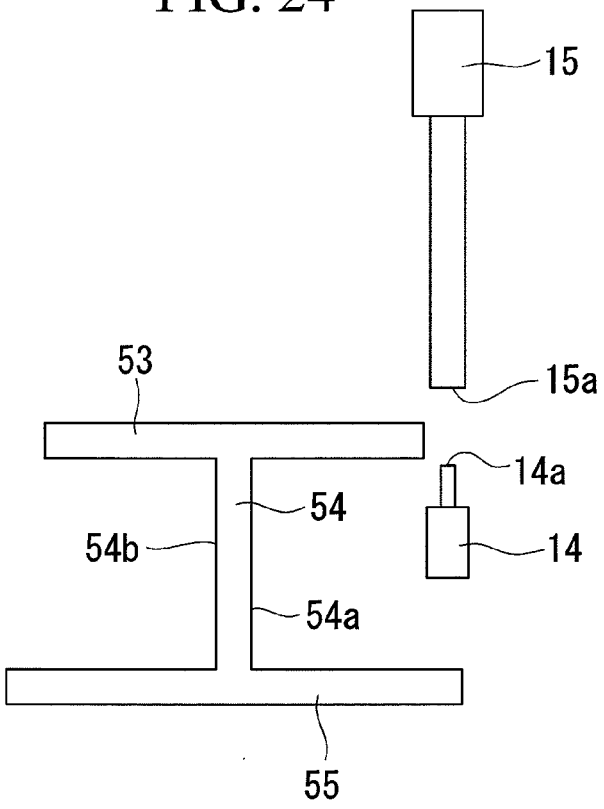
FIG. 24 is a view for explaining the stringer manufacturing method of the present invention and is a front view as viewed from the front.

After the portion of the web 54 located at one end portion of the elongated member 51 has been cut off, the abrasive nozzle assembly 14 and the catcher cup 15 are then disposed in a state shown in FIG. 24. Specifically, the abrasive nozzle assembly 14 and the catcher cup 15 are disposed at one lateral side of the elongated member 51 such that the abrasive nozzle assembly 14 is located lower than the cap flange 53 and the catcher cup 15 is located higher than the cap flange 53; the abrasive nozzle assembly 14 and the catcher cup 15 are disposed so as to be located in a plane orthogonal to the longitudinal axis of the elongated member 51; and the abrasive nozzle assembly 14 and the catcher cup 15 are disposed such that the central axis thereof is parallel to a one-lateral-side surface 54*a* and an other-lateral-side surface 54*b* of the web 54.

Figure 25:
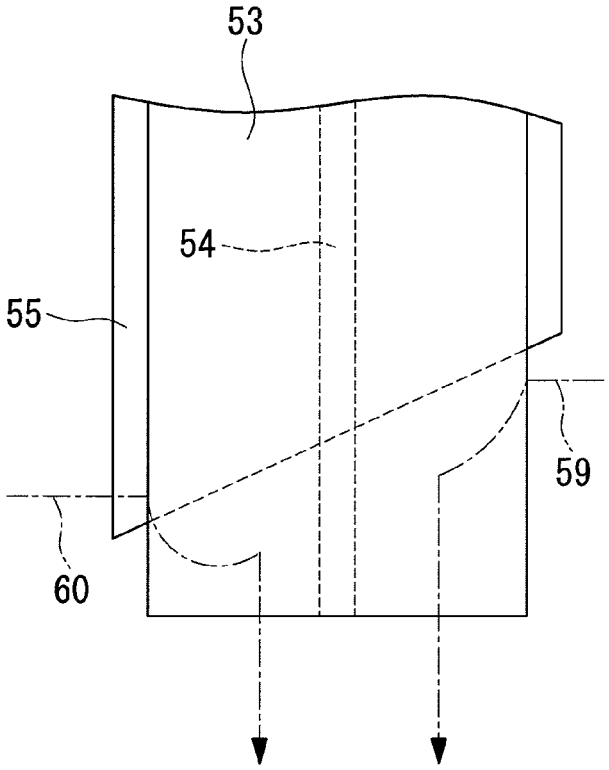
FIG. 25 is a view for explaining the stringer manufacturing method of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIG. 24, ultrahigh-pressure water containing abrasive is ejected again from the outlet 14*a* of the abrasive nozzle assembly 14, and the abrasive nozzle assembly 14 and the catcher cup 15 are moved along trim lines 59 and 60 indicated by one-dot chain lines in FIG. 25. At this time, the abrasive nozzle assembly 14 and the catcher cup 15 are moved while maintaining the state shown in FIG. 24. Through this stroke, both corner portions of the cap flange 53 located at one end portion of the elongated member 51 are cut off in a round shape.

Figure 26:
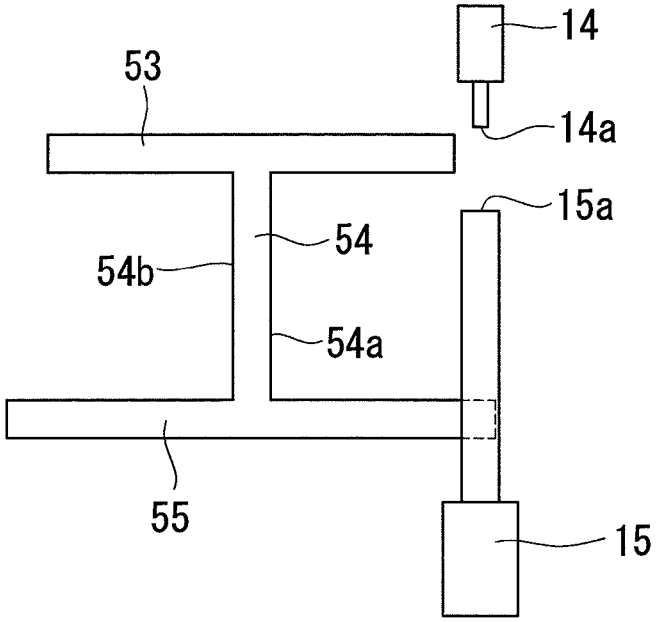
FIG. 26 is a view for explaining the stringer manufacturing methods of the present invention and is a front view as viewed from the front.

After both the corner portions of the cap flange 53 located at one end portion of the elongated member 51 have been cut off, the abrasive nozzle assembly 14 and the catcher cup 15 are then disposed in a state shown in FIG. 26. Specifically, the abrasive nozzle assembly 14 and the catcher cup 15 are disposed at one lateral side of the elongated member 51 such that the abrasive nozzle assembly 14 is located higher than the cap flange 53 and the catcher cup 15 is located lower than the cap flange 53; the abrasive nozzle assembly 14 and the catcher cup 15 are disposed so as to be located in a plane orthogonal to the longitudinal axis of the elongated member 51; and the abrasive nozzle assembly 14 and the catcher cup 15 are disposed such that the central axis thereof is parallel to the one-lateral-side surface 54*a* and the other-lateral-side surface 54*b* of the web 54.

Figure 27:
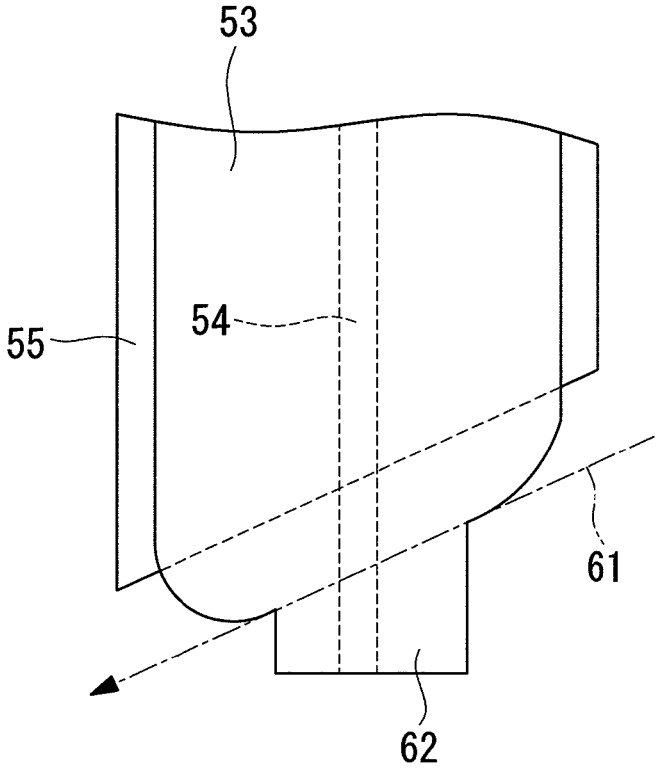
FIG. 27 is a view for explaining the stringer manufacturing method of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIG. 26, ultrahigh-pressure water containing abrasive is ejected again from the outlet 14*a* of the abrasive nozzle assembly 14, and the abrasive nozzle assembly 14 and the catcher cup 15 are moved along a trim line 61 indicated by a one-dot chain line in FIG. 27. At this time, the abrasive nozzle assembly 14 and the catcher cup 15 are moved while maintaining the state shown in FIG. 26. Through this stroke, a remaining portion (protruding portion) 62 of the cap flange 53 located at one end portion of the elongated member 51 is cut off in a trapezoidal shape in plan view (as viewed from above).

The thus-formed stringer 52 (see FIG. 6) is used (utilized) as a stringer that constitutes an aircraft main wing, for example.

According to the stringer manufacturing method of this embodiment, because the base flange 55 is machined prior to the cap flange 53, and cutting chips fall to the lower side, without being accumulated on the base flange 55, when the cap flange 53 is machined, the movements of the abrasive nozzle assembly 14 and the catcher cup 15 are not blocked by the cutting chips accumulated on the base flange 55.

Therefore, it is possible to efficiently machine the elongated member 51 and to further enhance the productivity.

Since the other functional effects are the same as those of the above-described embodiment, a description thereof will be omitted.

Finally, a description will be given of a stringer manufacturing method according to a fourth embodiment of the present invention, in which the 6-axis robot 1 is used to machine one end portion of an elongated member 71 shown in FIG. 7 into a shape shown in FIG. 8, thereby manufacturing a stringer 72.

The elongated member 71 is made, for example, of carbon fiber reinforced plastic (CFRP), which is formed by combining carbon fibers and plastic. As shown in FIG. 7, the elongated member 71 is provided with a cap flange 73, a web 74, and a base flange 75 slightly narrower than the cap flange 73 and is formed so as to have a T-shape (or an H-shape) in cross-section (front view). The cap flange 73, the web 74, and the base flange 75 are all plate-like members and are joined to form a single unit as a whole.

As in the above-described embodiments, the elongated member 71 is secured to special jigs (not shown), and the abrasive nozzle assembly 14 and the catcher cup 15 are disposed in the state shown in FIG. 18, as in the above-described third embodiment.

Figure 28:
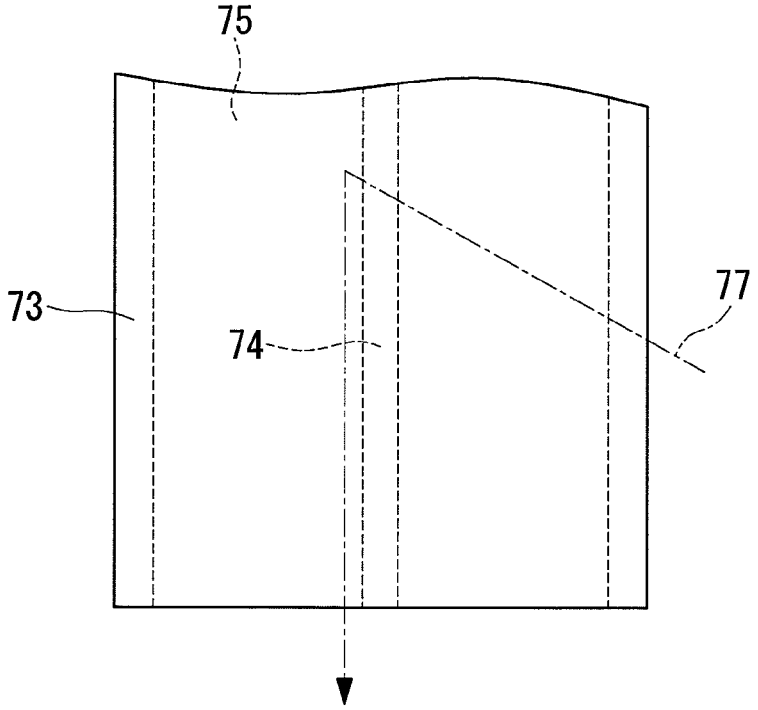
FIG. 28 is a view for explaining the stringer manufacturing method of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIG. 18, ultrahigh-pressure water containing abrasive is ejected again from the outlet 14*a* of the abrasive nozzle assembly 14, and the abrasive nozzle assembly 14 and the catcher cup 15 are moved along a trim line 77 indicated by a one-dot chain line in FIG. 28. At this time, the abrasive nozzle assembly 14 and the catcher cup 15 are moved while maintaining the state shown in FIG. 18. Through this stroke, a one-lateral-side portion of the base flange 75 and a lower end portion of the web 74 that are located at one end portion of the elongated member 71 are cut off in a trapezoidal shape in plan view (as viewed from above).

After the one-lateral-side portion of the base flange 75 and the lower end portion of the web 74 located at one end portion of the elongated member 71 have been cut off, the injection of ultrahigh-pressure water containing abrasive is stopped, and the abrasive nozzle assembly 14 and the catcher cup 15 are then disposed in the state shown in FIG. 20, as in the above-described third embodiment.

Figure 29:
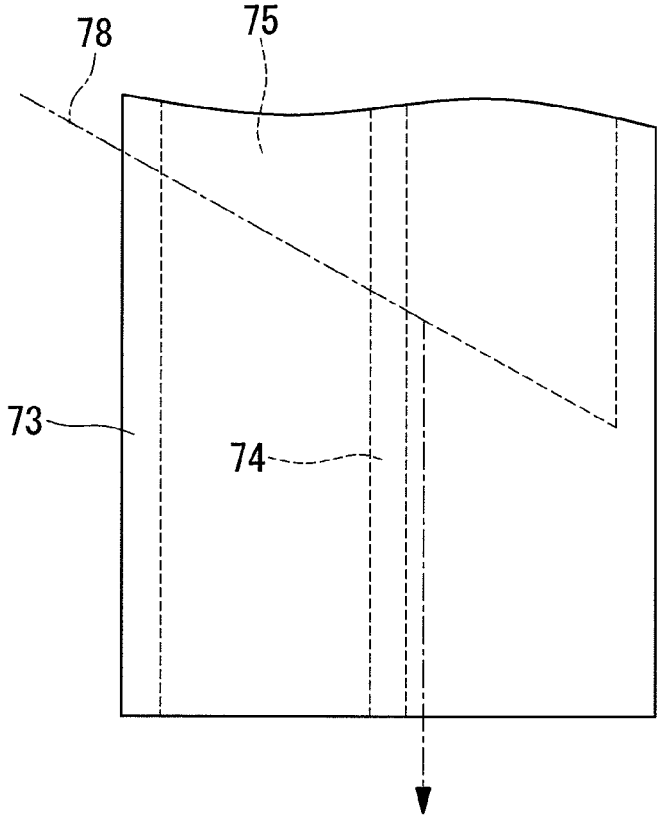
FIG. 29 is a view for explaining the stringer manufacturing method of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIG. 20, ultrahigh-pressure water containing abrasive is ejected again from the outlet 14*a* of the abrasive nozzle assembly 14, and the abrasive nozzle assembly 14 and the catcher cup 15 are moved along a trim line 78 indicated by a one-dot chain line in FIG. 29. At this time, the abrasive nozzle assembly 14 and the catcher cup 15 are moved while maintaining the state shown in FIG. 20. Through this stroke, an other-lateral-side portion of the base flange 75 and a lower end portion of the web 74 located at one end portion of the elongated member 71 are cut off in a trapezoidal shape in plan view (as viewed from above).

After the portion of the base flange 75 located at one end portion of the elongated member 71 has been cut off, the abrasive nozzle assembly 14 and the catcher cup 15 are then disposed in the state shown in FIG. 22, as in the above-described third embodiment.

Figure 30:
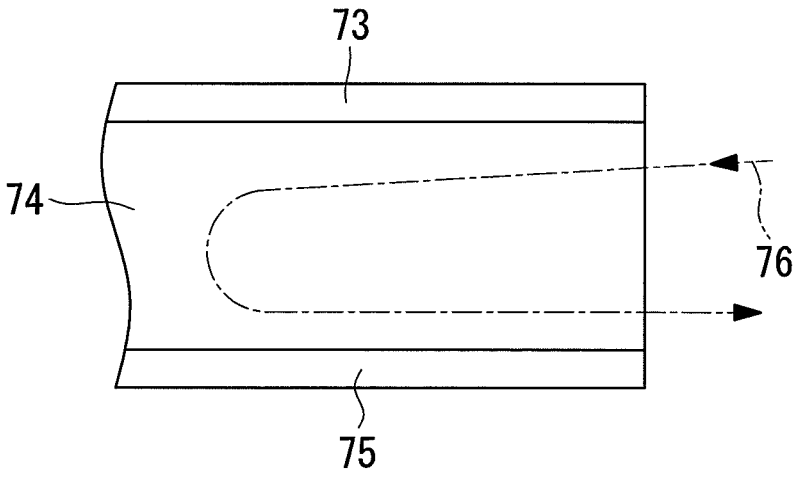
FIG. 30 is a view for explaining the stringer manufacturing method of the present invention and is a side view as viewed from a lateral side.

After the abrasive nozzle assembly 14 and the catcher cup 15 are disposed at the predetermined positions, specifically, after the abrasive nozzle assembly 14 and the catcher cup 15 are disposed in the state shown in FIG. 22, ultrahigh-pressure water containing abrasive is ejected from the outlet 14*a* of the abrasive nozzle assembly 14, and the abrasive nozzle assembly 14 and the catcher cup 15 are moved along a trim line 76 indicated by a one-dot chain line in FIG. 30. At this time, the abrasive nozzle assembly 14 and the catcher cup 15 are moved while maintaining the state shown in FIG. 22. Through this stroke, a portion of the web 74 located at one end portion of the elongated member 71 is cut off in a U-shape in side view (as viewed from a lateral side) and is cut more largely (more deeply) toward the other end of the elongated member 71 than in the above-described third embodiment.

After the portion of the web 74 located at one end portion of the elongated member 71 has been cut off, the abrasive nozzle assembly 14 and the catcher cup 15 are then disposed in the state shown in FIG. 26, as in the above-described third embodiment.

Figure 31:
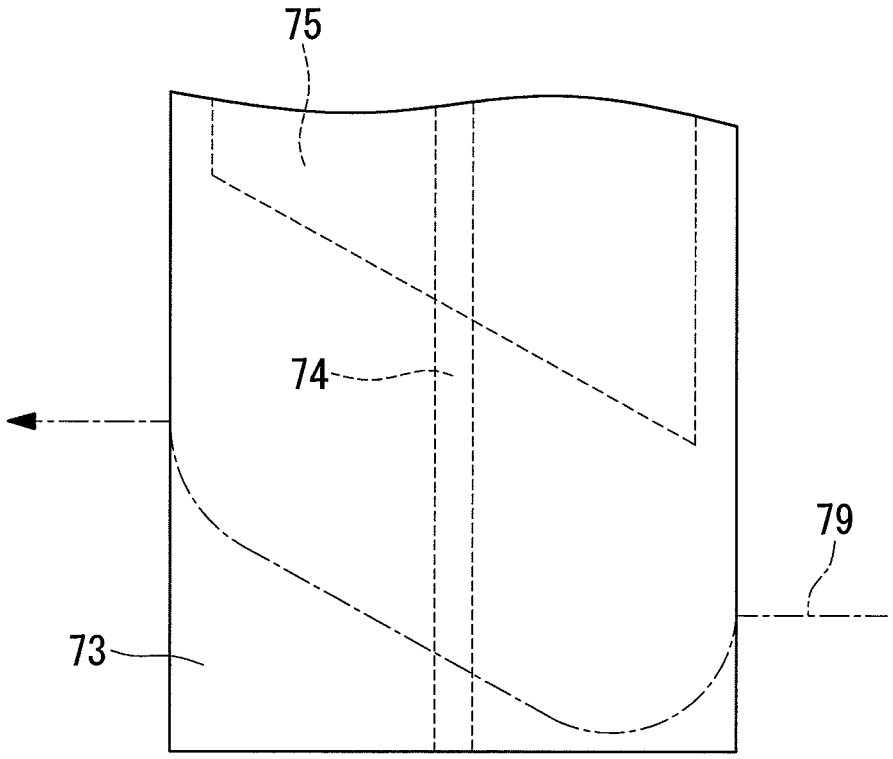
FIG. 31 is a view for explaining the stringer manufacturing method of the present invention and is a plan view as viewed from above.

After the abrasive nozzle assembly 14 and the catcher cup 15 are disposed at the predetermined positions, specifically, after the abrasive nozzle assembly 14 and the catcher cup 15 are disposed in the state shown in FIG. 26, ultrahigh-pressure water containing abrasive is ejected again from the outlet 14*a* of the abrasive nozzle assembly 14, and the abrasive nozzle assembly 14 and the catcher cup 15 are moved along a trim line 79 indicated by a one-dot chain line in FIG. 31. At this time, the abrasive nozzle assembly 14 and the catcher cup 15 are moved while maintaining the state shown in FIG. 26. Through this stroke, both corner portions of the cap flange 73 located at one end portion of the elongated member 71 are cut off in a round shape.

The thus-formed stringer 72 (see FIG. 8) is used (utilized) as a stringer that constitutes an aircraft main wing, for example.

Since the functional effects of this embodiment are the same as those of the above-described third embodiment, a description thereof will be omitted.

The present invention is not limited to the above-described embodiments, and various changes and modifications can be made without departing from the scope of the present invention.

Figure 32:
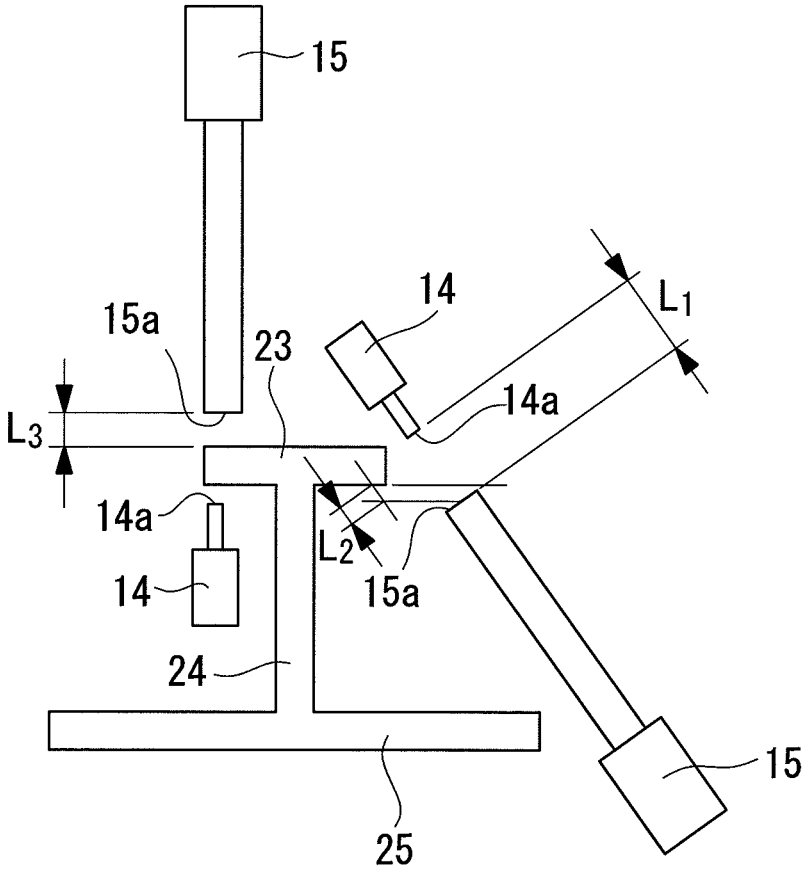
FIG. 32 is a view for explaining a stringer manufacturing method of another embodiment of the present invention and is a front view as viewed from the front.

In the above-described embodiments, it is more preferable that the 6-axis robot 1 be provided with a space adjustment mechanism (not shown) that adjusts the space between the abrasive nozzle assembly 14 and the catcher cup 15 such that the space between the catcher cup 15 and the elongated member 21, 51, or 71 is maintained constant, for example, such that L2 and L3 in FIG. 32 become equal (L2=L3).

As the space adjustment mechanism, a longitudinal motion mechanism that can move in a direction indicated by a white arrow in FIG. 1, such as an air cylinder (not shown), can be used. Thus, even when the plate thickness of a cut portion is changed, it is possible to maintain the space between the catcher cup 15 and the elongated member 21, 51, or 71 constant according to the change in the plate thickness of the cut portion, to easily recover ultrahigh-pressure water containing abrasive, to produce a smooth machined surface, thus eliminating a finishing process, and to further enhance the productivity. Since all of the ultrahigh-pressure water containing abrasive is recovered, it is possible to maintain the moving speed (specifically, cutting speed) of the abrasive nozzle assembly 14 and the catcher cup 15 constant and to further enhance the productivity.

In a case where the space adjustment mechanism is not provided, L1 in FIG. 32 is fixed. Thus, in some cases, L3 becomes larger than L2 in FIG. 32 (L3>L2), the recovery rate of ultrahigh-pressure water containing abrasive is reduced, and scattering abrasive may damage the workpiece.

REFERENCE SIGNS LIST

1 6-axis robot (vertical articulated robot)
12 arm
14 abrasive nozzle assembly
15 catcher cup
21 long member
22 stringer
23 cap flange
24 web
25 base flange
32 stringer
51 long member
52 stringer
53 cap flange
54 web
55 base flange
62 remaining portion
71 long member
72 stringer
73 cap flange
74 web
75 base flange

The invention claimed is:

1. A stringer manufacturing method for machining one end portion of an elongated member that is provided with a cap flange, a web, and a base flange and that has an inverted T-shape in a front view, an I-shape in a front view, or a T-shape in a front view into a desired shape to obtain a desired stringer, wherein the one end portion of the elongated member is machined into a desired shape by using a vertical articulated robot that has at least 6 axes and that has, at the tip of an arm, an abrasive nozzle assembly that injects ultrahigh-pressure water containing abrasive and a catcher cup that recovers the ultrahigh-pressure water injected from the abrasive nozzle assembly, the stringer manufacturing method comprising the steps of:

when the one end portion of the elongated member having the inverted T-shape in a front view is to be machined into a desired shape, disposing the abrasive nozzle assembly and the catcher cup at one lateral side of the elongated member such that the abrasive nozzle assembly is located higher than the cap flange and the catcher cup is located lower than the cap flange, and disposing the abrasive nozzle assembly so as to be located closer to the central axis of the elongated member than the catcher cup, and cutting off a one-lateral-side portion of the cap flange and an upper end portion of the web that are located at the one end portion of the elongated member;

disposing the abrasive nozzle assembly and the catcher cup at the other lateral side of the elongated member such that the abrasive nozzle assembly is located higher than the cap flange and the catcher cup is located lower than the cap flange, and disposing the abrasive nozzle assembly so as to be located closer to the central axis of the elongated member than the catcher cup, and cutting off an other-lateral-side portion of the cap flange and an upper end portion of the web that are located at the one end portion of the elongated member; and locating the catcher cup at one lateral side of the web, and locating the abrasive nozzle assembly at the other lateral side of the web, and disposing the abrasive nozzle assembly and the catcher cup such that the central axis thereof is parallel to an upper surface of the cap flange and a lower surface of the base flange, and cutting off a portion of the web that is located at the one end portion of the elongated member.

2. A stringer manufacturing method according to claim 1, wherein, at the tip of an arm, a space adjustment mechanism that adjusts the space between the abrasive nozzle assembly and the catcher cup so as to maintain the space between the catcher cup and the elongated member constant is further provided.

3. A stringer manufacturing method for machining one end portion of an elongated member that is provided with a cap flange, a web, and a base flange and that has an inverted T-shape in a front view, an I-shape in a front view, or a T-shape in front view into a desired shape to obtain a desired stringer, wherein the one end portion of the elongated member is machined into a desired shape by using a vertical articulated robot that has at least 6 axes and that has, at the tip of an arm, an abrasive nozzle assembly that ejects ultrahigh-pressure water containing abrasive and a catcher cup that recovers the ultrahigh-pressure water ejected from the abrasive nozzle assembly, the stringer manufacturing method comprising the steps of:

when the one end portion of the elongated member having the I-shape in a front view is to be machined into a desired shape, disposing the abrasive nozzle assembly and the catcher cup at one lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup, and cutting off a one-lateral-side portion of the base flange and a lower end portion of the web that are located at the one end portion of the elongated member;

disposing the abrasive nozzle assembly and the catcher cup at the other lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup, and cutting off an other-lateral-side portion of the base flange and a lower end portion of the web that are located at the one end portion of the elongated member;

locating the abrasive nozzle assembly at the other lateral side of the web, and disposing the abrasive nozzle assembly and the catcher cup such that the central axis thereof is parallel to an upper surface of the cap flange and a lower surface of the base flange, and cutting off a portion of the web that is located at the one end portion of the elongated member, and locating the catcher cup at one lateral side of the web;

disposing the abrasive nozzle assembly and the catcher cup at the one lateral side of the elongated member such that the abrasive nozzle assembly is located lower than the cap flange and the catcher cup is located higher than the cap flange, and disposing the abrasive nozzle assembly and the catcher cup such that the central axis thereof is parallel to a one-lateral-side surface and an other-lateral-side surface of the web, and cutting off both corner portions of the cap flange that are located at the one end portion of the elongated member; and disposing the abrasive nozzle assembly and the catcher cup at the one lateral side of the elongated member such that the abrasive nozzle assembly is located higher than the cap flange and the catcher cup is located lower than the cap flange, and disposing the abrasive nozzle assembly and the catcher cup such that the central axis thereof is parallel to the one-lateral-side surface and the other-lateral-side surface of the web, and cutting off a remaining portion of the cap flange that is located at the one end portion of the elongated member.

4. A stringer manufacturing method for machining one end portion of an elongated member that is provided with a cap flange, a web, and a base flange and that has an inverted T-shape in a front view, an I-shape in a front view, or a T-shape in a front view into a desired shape to obtain a desired stringer, wherein the one end portion of the elongated member is machined into a desired shape by using a vertical articulated robot that has at least 6 axes and that has, at the tip of an arm, an abrasive nozzle assembly that ejects ultra-high-pressure water containing abrasive and a catcher cup that recovers the ultrahigh-pressure water ejected from the abrasive nozzle assembly, the stringer manufacturing method comprising the steps of:

when the one end portion of the elongated member having the T-shape in a front view is to be machined into a desired shape, cutting off a one-lateral-side portion of the base flange and a lower end portion of the web that are located at the one end portion of the elongated member, after disposing the abrasive nozzle assembly and the catcher cup at one lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup;

cutting off an other-lateral-side portion of the base flange and a lower end portion of the web that are located at the one end portion of the elongated member, after disposing the abrasive nozzle assembly and the catcher cup at the other lateral side of the elongated member such that the abrasive nozzle assembly is located lower than the base flange and the catcher cup is located higher than the base flange, and disposing the abrasive nozzle assembly so as to be located closer to the central axis of the elongated member than the catcher cup;

cutting off a portion of the web that is located at the one end portion of the elongated member, after locating the catcher cup at one lateral side of the web, locating the abrasive nozzle assembly at the other lateral side of the web, and disposing the abrasive nozzle assembly and the catcher cup such that the central axis thereof is parallel to an upper surface of the cap flange and a lower surface of the base flange; and cutting off a portion of the cap flange that is located at the one end portion of the elongated member, after disposing the abrasive nozzle assembly and the catcher cup at the one lateral side of the elongated member such that the abrasive nozzle assembly is located higher than the cap flange and the catcher cup is located lower than the cap flange, and disposing the abrasive nozzle assembly and the catcher cup such that the central axis thereof is parallel to a one-lateral-side surface and an other-lateral-side surface of the web.

* * * * *